US011458601B2

(12) United States Patent
Chen

(10) Patent No.: US 11,458,601 B2
(45) Date of Patent: Oct. 4, 2022

(54) ONE-HANDED PIPE WRENCH

(71) Applicant: JS Products, Inc., Las Vegas, NV (US)

(72) Inventor: Chungeng Chen, Las Vegas, NV (US)

(73) Assignee: JS Products, Inc., Las Vegas, NV (US)

( * ) Notice: Subject to any disclaimer, the term of this patent is extended or adjusted under 35 U.S.C. 154(b) by 204 days.

(21) Appl. No.: 16/794,587

(22) Filed: Feb. 19, 2020

(65) Prior Publication Data

US 2020/0269394 A1 Aug. 27, 2020

Related U.S. Application Data

(60) Provisional application No. 62/808,718, filed on Feb. 21, 2019.

(51) Int. Cl.
*B25B 13/50* (2006.01)
*B25B 23/16* (2006.01)

(52) U.S. Cl.
CPC ..... *B25B 13/505* (2013.01); *B25B 23/16* (2013.01)

(58) Field of Classification Search
CPC . B25B 13/50; B25B 13/5008; B25B 13/5016; B25B 13/5025; B25B 13/5033; B25B 13/5041; B25B 13/505; B25B 23/16; B25B 13/28; B25B 13/04; B25B 13/46; E21B 19/161
See application file for complete search history.

(56) References Cited

U.S. PATENT DOCUMENTS

| | | | | |
|---|---|---|---|---|
| 706,042 | A | 8/1902 | Fields | |
| 739,316 | A | 9/1903 | Irland | |
| 831,750 | A | 9/1906 | Smith | |
| 868,126 | A | 10/1907 | Richards et al. | |
| 868,127 | A | 10/1907 | Richards | |
| 897,665 | A | 9/1908 | Rugg | |
| 1,382,832 | A | 6/1921 | Hill | |
| 1,482,223 | A | 1/1924 | Ellison | |
| 1,627,035 | A | 5/1927 | Jahn | |
| 2,713,803 | A * | 7/1955 | Schwaiger | B25B 13/48 74/159 |
| 4,616,534 | A * | 10/1986 | Park | B25B 13/28 81/99 |
| 4,689,865 | A * | 9/1987 | Chamblee | B25B 27/205 29/229 |
| 5,251,518 | A * | 10/1993 | Woo | B25B 13/505 81/58 |
| 6,128,943 | A * | 10/2000 | Lemmens | B25B 7/12 81/416 |
| 6,311,586 | B1 | 11/2001 | Hirse | |
| 6,742,419 | B2 * | 6/2004 | Chartier | B25B 13/505 81/111 |

(Continued)

*Primary Examiner* — Robert J Scruggs
(74) *Attorney, Agent, or Firm* — Weide & Miller, Ltd.

(57) ABSTRACT

A truly one-handed operable pipe wrench is provided which includes a handle having a first end and a second end, a fixed jaw disposed at the second end of the handle, and a rotatable jaw pivotally attached to the second end of the handle. The rotatable jaw includes a first engaging end and a second driven end. A lever arm is pivotally attached to the handle. The lever arm includes a handle portion and an actuating portion. When the lever arm rotates relative to the handle, the actuating portion is in contact with the second driven end of the rotatable jaw causing the rotatable jaw to rotate relative to the second end of the handle.

18 Claims, 4 Drawing Sheets

(56) References Cited

U.S. PATENT DOCUMENTS

| | | | | |
|---|---|---|---|---|
| 6,971,288 | B2 | 12/2005 | Wei | |
| 7,044,030 | B2 | 5/2006 | Chartier et al. | |
| 7,096,764 | B2 | 8/2006 | Zhingang | |
| 7,546,784 | B1 | 6/2009 | Yu | |
| 7,882,768 | B2 | 2/2011 | Urquizu Osa | |
| 9,248,554 | B2 * | 2/2016 | Cheng | B25B 13/28 |
| 2010/0242686 | A1 | 9/2010 | Gower | |
| 2015/0360350 | A1 * | 12/2015 | Jiang | B25B 13/5058 81/99 |

* cited by examiner

ONE-HANDED PIPE WRENCH

CROSS-REFERENCE TO RELATED APPLICATION

This application claims priority to U.S. Provisional Application No. 62/808,718, which was filed on Feb. 21, 2019, the contents of which are hereby incorporated by reference.

BACKGROUND

The disclosed embodiments generally relate to hand tools. More specifically, the disclosed embodiments relate to pipe wrenches, and particularly to adjustable pipe wrenches.

Pipe wrenches are well known in the industry as any of several types of wrenches that are configured to grasp and rotate threaded pipe and pipe fittings for assembly or disassembly. Many pipe wrenches are adjustable. For example, one common pipe wrench uses a manually actuated worm gear attached to an adjustable jaw to change the distance between the adjustable jaw and a fixed jaw.

Other examples of pipe wrenches include an adjustable jaw that is rotatable relative to a fixed jaw. One example of such a pipe wrench is shown in U.S. Pat. No. 6,742,419. There, a jaw member is pivotally mounted on a handle and may pivot from a closed to an open position. A projection on the back of the jaw member is configured to be actuated by a thumb of the person using the wrench to open the jaw. A torsion spring is provided that biases the jaw member into the closed position.

Such pipe wrenches have several drawbacks. Often, access to pipes is limited making it difficult for the person using the pipe wrench to easily access the pipes. This makes it difficult for the person using the pipe wrench to properly size the pipe wrench onto the pipe. Further, even with the thumb projection of an adjustable pipe wrench, the user still needs two hands to both hold the handle of the pipe wrench and to actuate the adjustable jaw of the pipe wrench. Additionally, the strength of the torsion spring biasing the adjustable jaw towards the closed position is limited so that the user is able to actuate the adjustable jaw with the thumb projection.

SUMMARY

In light of the foregoing, a pipe wrench is provided that can be truly one-handed in operation. In one embodiment, a pipe wrench includes a handle having a first end and a second end. The second end of the handle has a first side extension and a second side extension that together form a slot therebetween. The pipe wrench further includes a fixed jaw disposed at the second end of the handle. The fixed jaw includes an attachment projection that is configured to be inserted into the slot between the first and second side extensions.

The pipe wrench additionally includes a rotatable jaw pivotally attached to the second end of the handle between the first and second side extensions via a first pinned connection where the first pinned connection defines a first pivot point. The rotatable jaw has a first engaging end on a first side of the first pivot point and a second driven end on a second side of the first pivot point.

A lever arm is pivotally attached to the handle via a second pinned connection where the second pinned connection defines a second pivot point. The lever arm includes a handle portion extending from the second pivot point toward the first end of the handle and an actuating portion extending through the slot of the handle and contacting an external surface of the second driven end of the rotatable jaw.

In one embodiment, the pipe wrench further includes a torsion spring disposed at the second end of the handle. The torsion spring has a first arm connected to the attachment projection of the fixed jaw. The first arm of the torsion spring abuts against a straight portion of a raised profile disposed on an inside surface of each of the first and second side extensions. The torsion spring has a second arm that interfaces with an internal surface of the second driven end of the rotatable jaw. In this manner, the torsion spring biases the second driven end of the rotatable jaw to move the rotatable jaw about the first pivot point such that the first engaging end of the rotatable jaw moves towards the fixed jaw.

In one exemplary embodiment, the fixed jaw may include a convex set of teeth. The rotatable jaw may include a first row of teeth and a second row of teeth disposed at an angle relative to the first row of teeth.

In one embodiment, the handle portion of the lever arm is formed with a u-shaped slot. The handle is configured to at least partially fit within the u-shaped slot. The u-shaped slot of the handle portion may include a first sidewall and a second sidewall. The first sidewall and the second sidewall may each have an attachment flange.

The second pinned connection may be formed by a second pin that extends through the handle and the attachment flanges of the first and second sidewalls. A second circlip may secure the second pin and allow for relative rotation of the handle and the attachment flanges.

In some embodiments the lever arm may provide at least a two-to-one mechanical advantage for rotating the rotatable jaw when the lever arm is rotated about the second pivot point. The rotation of the lever arm about the second pivot point causes the actuated end of the lever arm to drive the external surface of the second driven end of the rotatable jaw to rotate the rotatable jaw about the first pivot point.

The first pinned connection may include a first pin that extends through the rotatable jaw and the first and second side extensions of the handle. A first circlip may secure the first pin and allow for relative rotation of the rotatable jaw the first and second side extensions.

In another exemplary embodiment, a pipe wrench is provided which includes a handle having a first end and a second end, a fixed jaw disposed at the second end of the handle, and a rotatable jaw pivotally attached to the second end of the handle. The rotatable jaw includes a first engaging end and a second driven end. A lever arm is pivotally attached to the handle. The lever arm includes a handle portion and an actuating portion. When the lever arm rotates relative to the handle, the actuating portion is in contact with the second driven end of the rotatable jaw causing the rotatable jaw to rotate relative to the second end of the handle.

The fixed jaw may include a convex set of teeth. The rotatable jaw may include a first row of teeth and a second row of teeth disposed at an angle relative to the first row of teeth. The pipe wrench may also have a spring configured to bias the rotatable jaw towards the fixed jaw and into a closed position. The spring may be a torsion spring. The handle portion of the lever arm may be formed with a u-shaped slot where the handle at least partially fits within the u-shaped slot. The handle may include a tethering aperture at the first end.

BRIEF DESCRIPTION OF THE DRAWINGS

The components in the figures are not necessarily to scale, emphasis instead being placed upon illustrating the principles of the embodiments of the invention. In the figures, like reference numerals designate corresponding parts throughout the different views.

DETAILED DESCRIPTION OF EMBODIMENTS

Figure 1:
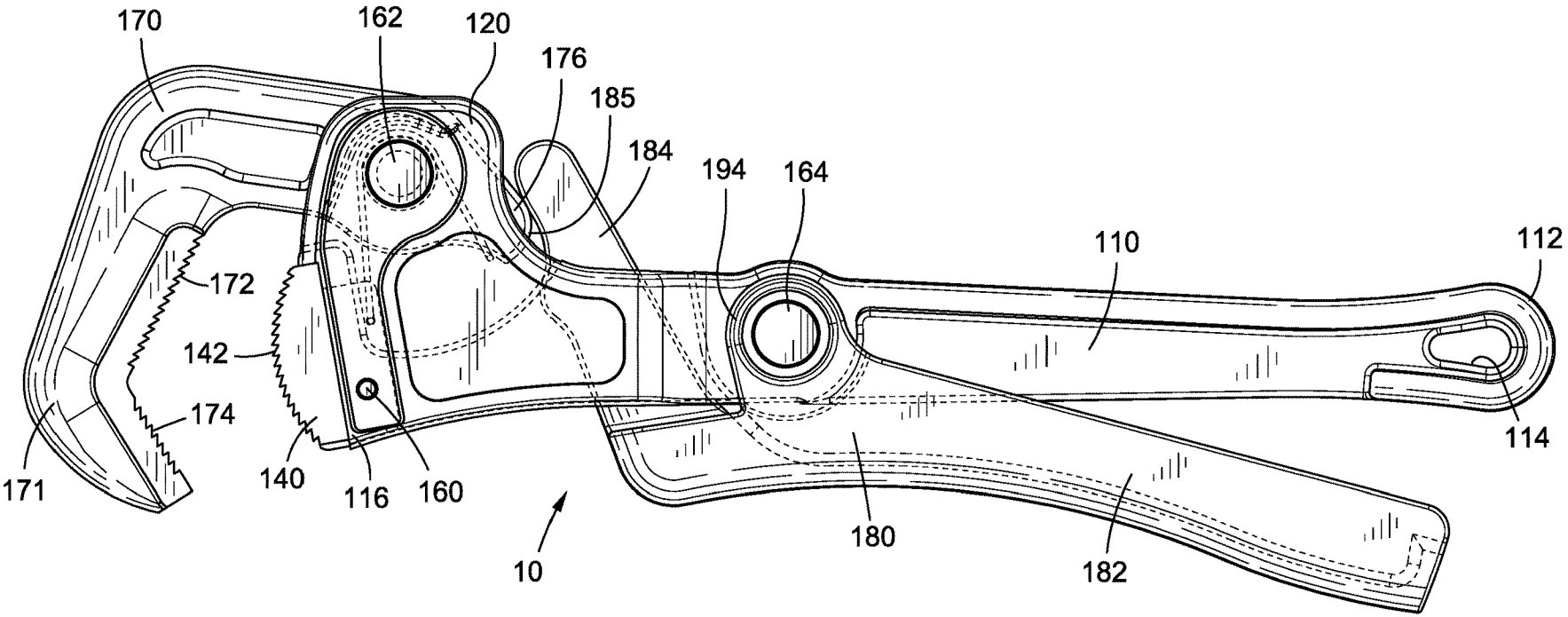
FIG. 1 is a side view of a one-handed pipe wrench, according to an exemplary embodiment.
Figure 2:
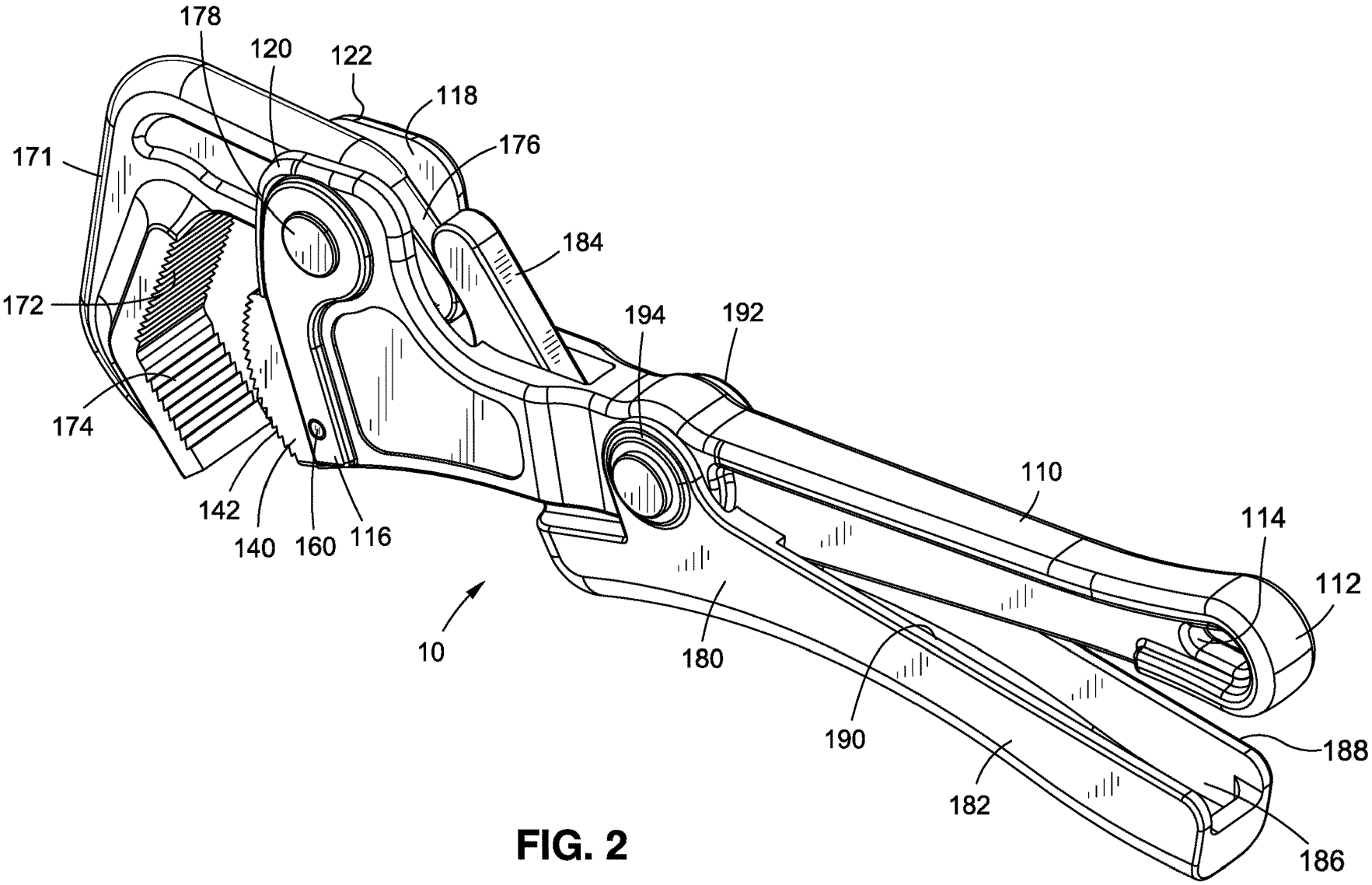
FIG. 2 is a perspective view of the one-handed pipe wrench shown in FIG. 1.

A pipe wrench that may be truly operable with one hand is described with reference to FIGS. 1-4. The pipe wrench 10 includes a handle 110. The handle 110 has a first end 112 with a tethering aperture 114 and a second end 116. The handle 110 may be formed from cast iron and machine finished to shape. In some other embodiments, the handle 110 may be aluminum die cast which results in a much lighter tool.

Figure 3:
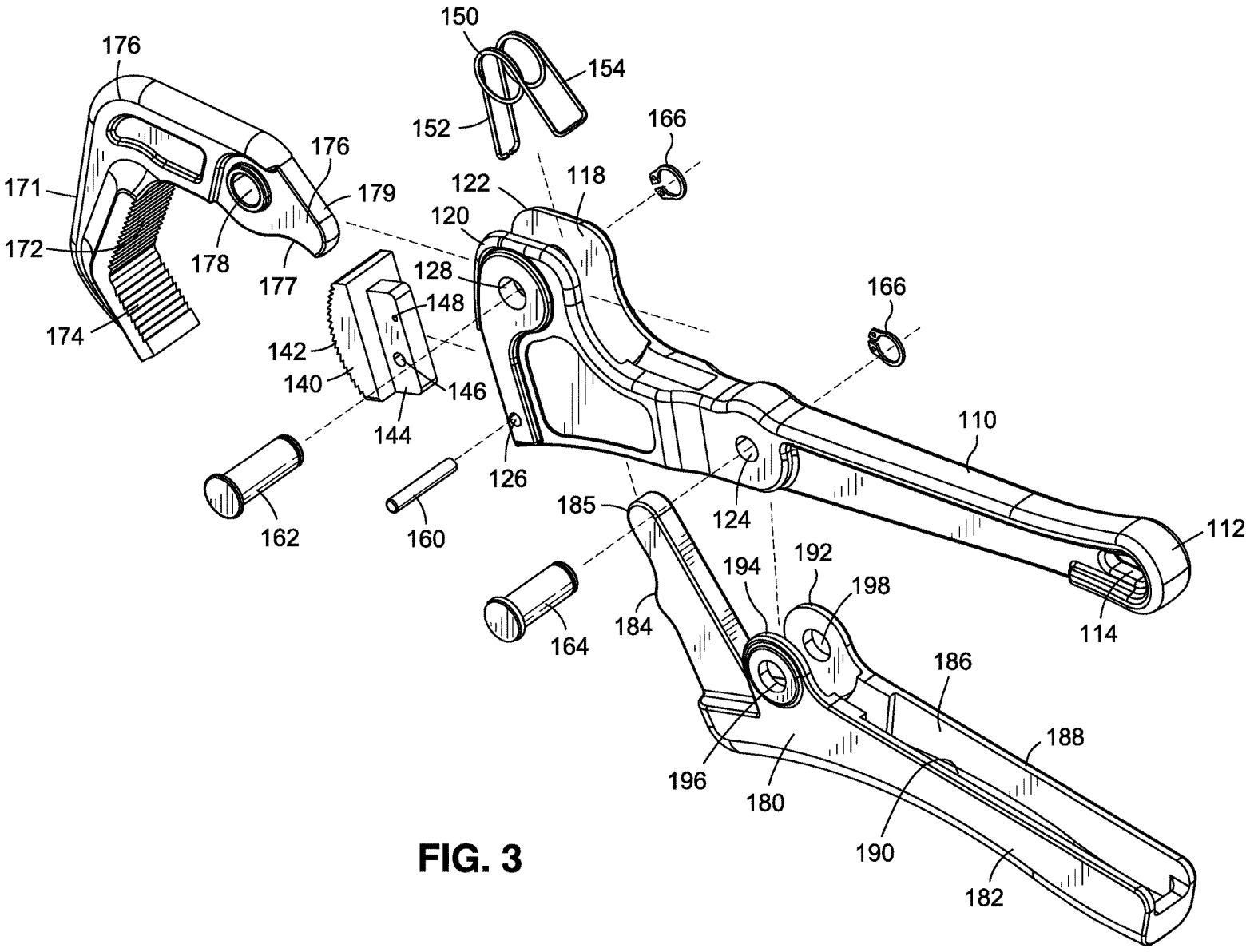
FIG. 3 is an exploded view of the one-handed pipe wrench shown in FIG. 1.

As best shown in FIG. 3, the handle 110 includes a slot 118 extending from the second end 116. The slot 118 is surrounded by a first side extension 120 and a second side extension 122. The handle 110 comprises a lever arm attachment hole 124 to facilitate the attachment of the lever arm 180 which will be described in more detail below. The handle 110 further comprises a fixed jaw attachment hole 126 to facilitate attachment of a fixed jaw 140 (described below) and an adjustable jaw attachment hole 128 to facilitate attachment of an adjustable jaw 170 (described below).

Figure 4:
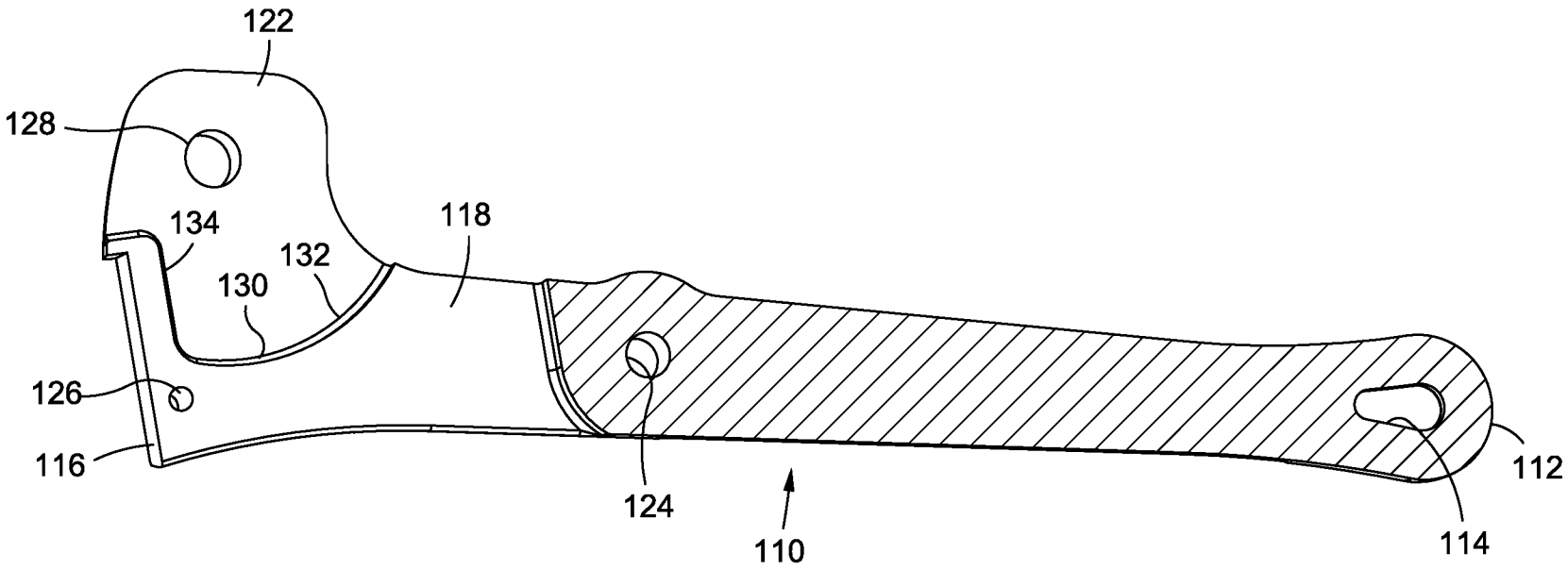
FIG. 4 is a section view of a handle of a one-handed pipe wrench, according to an exemplary embodiment.

As shown in FIG. 4, the second side extension 122 that together with the first side extension defines the slot 118, includes a raised profile 130. The raised profile includes a concave curved portion 132 extending toward the second end 116 of the handle and a straight portion 134 that extends parallel to a top surface of the end 116 of the handle 110 as shown in FIG. 4. The raised profile defines an area in which the adjustable jaw 170 rotates and provides a stop surface for a torsion spring 150 as explained below.

The fixed jaw 140 of the pipe wrench 10 is attached to the handle 110 at the second end 116. The fixed jaw 140 includes a convex row of teeth 142 that are configured for gripping onto a pipe or other member to be gripped by the pipe wrench 10. As shown in FIG. 3, the fixed jaw 140 comprises an attachment projection 144 that projects from a bottom surface of the fixed jaw 140. The attachment projection 144 is configured to extend into the slot 118 of the handle 110 between the first and second side extensions 120, 122. The attachment projection 144 comprises a pin receiving aperture 146 and a torsion spring aperture 148.

The fixed jaw 140 is connected to the handle by way of a pin 160 or another suitable fastener. The pin 160 extends through the fixed jaw attachment hole 126 of the handle 110 and the pin receiving aperture 146 of the fixed jaw 140, thereby securing the fixed jaw 140 to the handle 110. The torsion spring aperture 148 is configured to connect to the torsion spring 150. The torsion spring 150 has a first arm 152 and a second arm 154. The first arm 152 has extensions that are inserted through the torsion spring aperture 148. When the fixed jaw 140 and torsion spring 150 are assembled within the slot 118 of the handle 110, the first arm 152 of the torsion spring 150 abuts against the straight portion 134 of the raised profile 130. In this manner the torsion spring 150 creates a second attachment point for the fixed jaw 140 to securely hold the fixed jaw 140 in place.

The adjustable jaw 170 attaches to the handle 110 such that the adjustable jaw 170 may rotate away from and back towards the fixed jaw 140 to be able to grip differently sized pipes, pipe fittings, and the like. The adjustable jaw 170 is a "hook" jaw and includes a first engaging end 171 comprising a first row of teeth 172 and a second row of teeth 174. The first and second rows of teeth 172, 174 of the adjustable jaw 170 are set at an angle relative to one another so that they, along with convex teeth 142 of the fixed jaw 140, make three points of contact on a pipe, pipe fitting, or the like during use. The adjustable jaw 170 and the fixed jaw 140 may be manufactured from a steel alloy using a forging process and may be machine finished. Other suitable materials may also be used.

The adjustable jaw 170 comprises a handle connection aperture 178 via which the adjustable jaw 170 is rotatably connected to the handle 110. A pin 162 is provided that is inserted through the adjustable jaw attachment holes 128 of the first and second side extensions 120, 122 of the handle 110. The pin 162 may be secured in place by way of a circlip 166 to allow for the rotation of the adjustable jaw 170 relative to the handle 110. Accordingly, the pin 162 and connection between the adjustable jaw 170 and the handle 110 define a first pivot point about which the adjustable jaw 170 rotates.

The adjustable jaw 170 is rotated about the pin 162 by actuating the driven end 176 of the adjustable jaw 170. The driven end 176 extends on one side of the first pivot point, while the engaging end 171 extends on the other side of the first pivot point. Thus, as shown, movement of the driven end 176 into the slot 118 of the handle results in rotation of the engaging end 171 away from the fixed jaw 140. In this embodiment, the second arm 154 of the torsion spring 150 applies a force against an interior surface 177 of the second driven end 176 of the adjustable jaw 170. The torsion spring thus biases the driven end in a direction out of the slot 118 which results in movement of the engaging end 171 of the adjustable jaw 170 towards a closed position, i.e. towards the fixed jaw 140.

Instead of being manually opened by the hand, thumb, or finger of a user, the adjustable jaw 170 is opened (rotated such that the first and second rows of teeth 172, 174 rotate away from the convex teeth 142 of the fixed jaw 140) using a lever arm 180. The lever arm 180 comprises a handle portion 182 and an actuating portion 184. The handle portion 182 of the lever arm is formed in a u-shaped with a first sidewall 188 and a second sidewall 190 forming a slot 186. The slot 186 has a width such that the handle 110 may at least partially fit into the slot 186.

The lever arm 180 connects to the handle 110 via the lever arm attachment hole 124. The first and second sidewalls 188, 190 respectively comprise a first and second attachment flange 192, 194. The first and send attachment flanges 192, 194 each respectively comprise a through hole 196, 198. A pin 164 (or other suitable fastener) is configured to extend through the through holes 196, 198 and the lever arm attachment hole 124 to rotatably connect the lever arm 180 to the handle 110. A circlip 166 may be used to secure the pin 163 in place and allow relative rotation of the lever arm 180 and handle 110. Accordingly, the pin 164 at the connection between the lever arm 180 and the handle 110 defines a second pivot point about which the lever arm 180 rotates.

The handle portion 182 of the lever arm 180 extends from the second pivot point towards the first end 112 of the handle 110. In this manner, when the handle portion 182 of the lever arm 180 is actuated by a user, the handle portion 182 is pulled toward the handle 110, and the slot 186 slides at least partially over the handle 110. The actuating portion 184 extends from the second pivot point through the slot 118 of the handle 110. The actuating portion 184 of the lever arm 180 may include a driving surface 185. The driving surface 185 is configured to interface with an exterior surface 179 of the driven end 176 of the adjustable jaw 170. In this manner, rotation of the lever arm 180 about the second pivot point results in the driving surface 185 of the actuating portion 184 engaging with the exterior surface 179 of the driven end 176 of the adjustable jaw 170. The driven end 176 moves into the slot 118 and the adjustable jaw 170 rotates about the first pivot point, causing the engaging end 171 of the adjustable jaw 170 to move away from the fixed jaw 140, thus effectively opening the jaws relative to one another (such as to release the wrench 10 from a pipe or to open the jaws to a point where a pipe can be inserted therebetween, as described below).

The lever arm 180 may be formed from a polymer-based material such as fiber reinforced nylon. The lever arm 180 may be manufactured via an injection molding process.

During use, the user may hold the pipe wrench 10 via the handle 110. To attach the jaws 140, 170 to a workpiece to be rotated, the user may rotate the adjustable jaw 170 away from the fixed jaw 140 by pulling the handle portion 182 of the lever arm 180 toward the handle 110. This causes the lever arm 180 to rotate about the pin 164. The resulting motion of the actuating portion 184 of the lever arm 180 causes the driving surface 185 to engage with and drive the external surface 179 of the driven end 176 of the adjustable jaw 170 to rotate the adjustable jaw about the pin 162. This moves the engaging end 171 of the adjustable jaw 170 away from the fixed jaw 140 and into an open position, allowing the pipe wrench 10 to engage with a workpiece. After using the pipe wrench 10, the torsion spring 150 biases the adjustable jaw 170 back towards the fixed jaw 140 and into the closed position.

The incorporation of the lever arm 180 creates a truly one-handed operable pipe wrench as the lever arm 180 can be easily actuated by the same hand holding the handle 110. Further, the handle portion 182 of the lever arm 180 is longer than actuating portion 184 of the lever arm 180, creating a mechanical advantage. This allows the torsion spring to be stronger than in previous pipe wrenches providing more gripping force during use. In this manner, the pipe wrench 10 may meet or exceed federal specification GGG-W-651E with the user still being able to comfortably actuate the adjustable jaw 170 with the lever arm 180. In this embodiment, the mechanical advantage may be a two-to-one mechanical advantage. However in some embodiments, the lengths of the handle portion 182 relative to the actuating portion 184 may provide a larger or a smaller mechanical advantage depending on the application and/or the size of the pipe wrench 10.

While exemplary embodiments have been described above with reference to the drawings, the wrench may have various other configurations. For example, the wrench described above has a slot 118 in the handle 110 through which the actuating portion 184 of the lever arm 180 interacts with the adjustable jaw 170. In another embodiment, the handle may have no slot, and the lever arm may have an actuating portion that extends on one or both sides of the handle to interface with the adjustable jaw.

As another example, different mechanisms for biasing the rotatable jaw may be used. The above-described torsion spring is one type biasing mechanism. However, other types of springs including coil spring, leaf spring etc. may be used. The location of the biasing mechanism may also vary so long as a biasing force pivots the adjustable jaw to closed position. One example may a leaf or coil spring instead of a torsion spring that acts against the interior surface 177 of the adjustable jaw 170. In another example, the actuating portion 184 of the lever arm 180 may be mechanically linked to the adjustable jaw, and a torsion spring may be placed adjacent to the pin 164. Alternatively, a coil spring may be placed between the handle portion 182 of the lever arm 180 and the handle 110. These examples, of course, are exemplary and others may be within the scope of the disclosure.

Above, the fixed jaw 140 is attached to the handle 110 via the flange. However, the fixed jaw 140 may be formed integrally with the handle 110.

In the above-described embodiments, the lever 180 is used to actuate and open the rotatable jaw. Other types of actuators other than the lever arm 180 may be used that are preferably disposed towards the first end 112 of the handle 110 and within reach of the hand of the user holding the handle 110. For example, a wrench may have a handle-mounted adjustable jaw actuator such as a sliding or twisting actuator that is actuated or engaged at the first end 112 of the handle 110 preferably actuatable while the user grips the handle at the distal end 112, but which is configured to remotely actuate the adjustable jaw 170.

The configuration of various of the components might be reversed or interchanged. For example, instead of the handle having a slot that the adjustable jaw fits into, the adjustable jaw might have two portions that defines a slot therebetween for receiving the handle.

While various embodiments of the invention have been described, it will be apparent to those of ordinary skill in the art that many more embodiments and implementations are possible that are within the scope of this invention. In addition, the various features, elements, and embodiments described herein may be claimed or combined in any combination or arrangement.

What is claimed is:

1. A pipe wrench comprising:

a handle comprising a first end and a second end, the second end comprising a first side extension and a second side extension forming a slot therebetween;

a fixed jaw disposed at the second end of the handle, the fixed jaw comprising an attachment projection configured to be inserted into the slot between the first and second side extensions;

a rotatable jaw pivotally attached to the second end of the handle between the first and second side extensions via a first pinned connection, the first pinned connection defining a first pivot point, the rotatable jaw comprising a first engaging end on a first side of the first pivot point and a second driven end on a second side of the first pivot point;

a lever arm pivotally attached to the handle via a second pinned connection, the second pinned connection defining a second pivot point, the lever arm comprising a handle portion extending from the second pivot point toward the first end of the handle and an actuating portion extending through the slot of the handle and contacting an external surface of the second driven end of the rotatable jaw; and a spring configured to bias the rotatable jaw towards the fixed jaw and into a closed position, wherein the spring is a torsion spring.

2. The pipe wrench of claim 1, wherein the handle portion of the lever arm is formed with a u-shaped slot, and the handle at least partially fits within the u-shaped slot.

3. The pipe wrench of claim 2, wherein the u-shaped slot of the handle portion comprises a first sidewall and a second sidewall.

4. The pipe wrench of claim 3, wherein the first sidewall and the second sidewall each comprise an attachment flange.

5. The pipe wrench of claim 4, wherein the second pinned connection comprises a second pin that extends through the handle and the attachment flanges of the first and second sidewalls, and a second circlip securing the second pin and allowing for relative rotation of the handle and the attachment flanges.

6. The pipe wrench of claim 1, wherein the lever arm provides at least a two-to-one mechanical advantage for rotating the rotatable jaw when the lever arm is rotated about the second pivot point causing the actuated end of the lever arm to drive the external surface of the second driven end of the rotatable jaw to rotate the rotatable jaw about the first pivot point.

7. The pipe wrench of claim 1 wherein the first pinned connection comprises a first pin that extends through the rotatable jaw and the first and second side extensions, and a first circlip securing the first pin and allowing for relative rotation of the rotatable jaw the first and second side extensions.

8. The pipe wrench of claim 1, wherein the torsion spring has a first portion which engages the fixed jaw and a second portion which engages the rotatable jaw.

9. The pipe wrench of claim 1, wherein the torsion spring is located between the first and second side extensions of the handle.

10. A pipe wrench comprising:

a handle comprising a first end and a second end, the second end comprising a first side extension and a second side extension forming a slot therebetween;

a fixed jaw disposed at the second end of the handle, the fixed jaw comprising an attachment projection configured to be inserted into the slot between the first and second side extensions;

a rotatable jaw pivotally attached to the second end of the handle between the first and second side extensions via a first pinned connection, the first pinned connection defining a first pivot point, the rotatable jaw comprising a first engaging end on a first side of the first pivot point and a second driven end on a second side of the first pivot point; and a lever arm pivotally attached to the handle via a second pinned connection, the second pinned connection defining a second pivot point, the lever arm comprising a handle portion extending from the second pivot point toward the first end of the handle and an actuating portion extending through the slot of the handle and contacting an external surface of the second driven end of the rotatable jaw, and a torsion spring disposed at the second end of the handle, the torsion spring having a first arm connected to the attachment projection of the fixed jaw, the first arm abutting against a straight portion of a raised profile disposed on an inside surface of each of the first and second side extensions, and the torsion spring having a second arm that interfaces with an internal surface of the second driven end of the rotatable jaw, wherein the torsion spring biases the second driven end of the rotatable jaw to move the rotatable jaw about the first pivot point such that the first engaging end of the rotatable jaw moves towards the fixed jaw.

11. The pipe wrench of claim 10 wherein the fixed jaw comprises a convex set of teeth.

12. The pipe wrench of claim 11, wherein the rotatable jaw comprises a first row of teeth and a second row of teeth disposed at an angle relative to the first row of teeth.

13. A pipe wrench comprising:

a handle comprising a first end and a second end;

a fixed jaw disposed at the second end of the handle;

a rotatable jaw pivotally attached to the second end of the handle, rotatable jaw comprising a first engaging end and a second driven end;

a lever arm pivotally attached to and extending through the handle, the lever arm comprising a handle portion and an actuating portion wherein when the lever arm rotates relative to the handle, the actuating portion is in contact with the second driven end of the rotatable jaw causing the rotatable jaw to rotate relative to the second end of the handle; and a spring configured to bias the rotatable jaw towards the fixed jaw and into a closed position, wherein the spring is a torsion spring.

14. The pipe wrench of claim 13, wherein the fixed jaw comprises a convex set of teeth.

15. The pipe wrench of claim 14, wherein the rotatable jaw comprises a first row of teeth and a second row of teeth disposed at an angle relative to the first row of teeth.

16. The pipe wrench of claim 13, wherein the handle portion of the lever arm is formed with a u-shaped slot, and the handle at least partially fits within the u-shaped slot.

17. The pipe wrench of claim 13, wherein the handle comprises a tethering aperture at the first end.

18. The pipe wrench of claim 13, wherein the torsion spring has a first portion which engages the fixed jaw and a second portion which engages the rotatable jaw.

* * * * *